US005909196A

United States Patent [19]

O'Neill, Jr.

[11] Patent Number: 5,909,196

[45] Date of Patent: Jun. 1, 1999

[54] DUAL FREQUENCY BAND QUADRIFILAR HELIX ANTENNA SYSTEMS AND METHODS

[75] Inventor: Gregory A. O'Neill, Jr., Apex, N.C.

[73] Assignee: Ericsson Inc., Research Triangle Park, N.C.

[21] Appl. No.: 08/770,904

[22] Filed: Dec. 20, 1996

[51] Int. Cl.[6] ..... H01Q 1/36

[52] U.S. Cl. ..... 343/895; 343/853

[58] Field of Search ..... 343/895, 850, 343/853, 876, 701; H01Q 1/38, 1/36

[56] References Cited

U.S. PATENT DOCUMENTS

| | | | |
|---|---|---|---|
| 3,083,364 | 3/1963 | Scheldorf | 343/895 |
| 4,008,479 | 2/1977 | Smith | 343/895 |
| 4,012,744 | 3/1977 | Greiser | 343/895 |
| 4,031,540 | 6/1977 | Borys, Jr. | 343/860 |
| 4,103,304 | 7/1978 | Burnham et al. | 343/853 |

(List continued on next page.)

FOREIGN PATENT DOCUMENTS

| | | |
|---|---|---|
| 0 593 185 A1 | 1/1993 | European Pat. Off. . |
| 0 320 404 B1 | 3/1993 | European Pat. Off. . |
| 0 632 603 A1 | 6/1994 | European Pat. Off. . |
| 0 729 239 A1 | 8/1996 | European Pat. Off. . |
| 0791978 | 8/1997 | European Pat. Off. . |
| 0 427 654 A1 | 7/1990 | France . |
| WO 90/13152 | 11/1990 | WIPO . |
| WO 98/05087 | 2/1998 | WIPO . |
| WO 98/05090 | 2/1998 | WIPO . |

OTHER PUBLICATIONS

Kraus, John D., *Antennas,* pp. 332–339 2$^{nd}$ Ed. (1988).

R. M. Fano, Theoretical Limitations on the Broadband Matching of Arbitrary Impedances, Technial Report No. 41, Massachusetts Institute of Technology, (Jun. 1947).

Thomas R. Cuthbert, Jr., Broadband Impedance Matching—Fast and Simple, *RF Matching Networks,* Nov. 1994, pp. 38–50.

William E. Sabin, Broadband HF Antenna Matching with ARRL Radio Designer, *QST,* Aug., 1995, pp. 33–36.

Maximising Monopole Bandwidth, *Electronics World & Wireless World,* Dec., 1994.

Robert J. Dehoney, Program Synthesizes Antenna Matching Networks for Maximum Bandwidth, *QST,* May, 1995.

Mikael Öhgren, Resonant Kvadrifilär Helixantenn för Mobilkommunikation via Satellit, *Saab Ericsson Space,* Document No. SE/REP/0200/A, Jan. 5, 1996.

(List continued on next page.)

*Primary Examiner*—Don Wong
*Assistant Examiner*—Tho Phan
*Attorney, Agent, or Firm*—Myers Bigel Sibley & Sajovec

[57] ABSTRACT

A quadrifilar helix antenna system capable of providing a positive gain, quasi-hemispherical antenna pattern over widely separate transmit and receive frequency bands. This new antenna system comprises concentrically arranged, but electrically isolated, transmit and receive quadrifilar helix antennas, each of which comprises two bifilar helices arranged orthogonally and excited in phase quadrature. In the preferred embodiment, the antenna elements forming each bifilar helix are short-circuited at their distal ends, and energy is induced from the receive antenna and coupled to the transmit antenna via receive and transmit 90° hybrid couplers which are electrically connected to the bifilar loops of the respective receive and transmit antennas. Also provided are switches or other disconnection means which are used to electrically isolate the transmit antenna during periods when the antenna is receiving a signal and to electrically isolate the receive antenna during periods of transmission. In the preferred embodiments, these disconnecting means are implemented as PIN diodes or radio frequency Gallium arsenide field effect transistor switches.

23 Claims, 4 Drawing Sheets

U.S. PATENT DOCUMENTS

| | | | |
|---|---|---|---|
| 4,349,824 | 9/1982 | Harris | 343/700 |
| 4,554,554 | 11/1985 | Olesen et al. | 343/895 |
| 4,608,574 | 8/1986 | Webster et al. | 343/895 |
| 4,672,686 | 6/1987 | Raoux et al. | 455/123 |
| 4,780,727 | 10/1988 | Seal et al. | 343/895 |
| 4,827,270 | 5/1989 | Udagawa et al. | 343/853 |
| 5,054,114 | 10/1991 | Erickson | 455/78 |
| 5,138,331 | 8/1992 | Josypenko | 343/895 |
| 5,170,176 | 12/1992 | Yasunaga et al. | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,349,365 | 9/1994 | Ow et al. | 343/895 |
| 5,444,455 | 8/1995 | Louzir et al. | 343/895 |
| 5,485,170 | 1/1996 | McCarrick | 343/895 |
| 5,489,916 | 2/1996 | Waterman et al. | 343/895 |
| 5,572,172 | 11/1996 | Standke et al. | 343/895 |
| 5,572,227 | 11/1996 | Pal et al. | 343/727 |
| 5,581,268 | 12/1996 | Hirshfield | 343/895 |
| 5,587,719 | 12/1996 | Steffy | 343/895 |
| 5,594,461 | 1/1997 | O'Neill, Jr. | 343/895 |
| 5,706,019 | 1/1998 | Darden, IV et al. | 343/895 |
| 5,754,143 | 5/1998 | Warnagiris et al. | 343/767 |

OTHER PUBLICATIONS

C.C. Kilgus, Resonant Quadrifilar Helix Design, *The Microwave Journal,* Dec. 1970, pp. 49–54.

Arlon T. Adams, et al., The Quadrifilar Helix Antenna, *IEEE Transactions of Antennas and Propogation,* vol. AP–22, No. 2, Mar. 1974, pp. 173–178.

S.A. Schelkunoff, A General Radiation Formula, *Proceedings of the I.R.E.,* Oct., 1939, pp. 660–666.

C.C. Kilgus, Multielement, Fractional Turn Helices, *IEEE Transactions on Antennas and Propogation,* Jul., 1968.

C.C. Kilgus, Resonant Quadrifilar Helix, *IEEE Transactions on Antennas and Propogation,* May, 1969.

DUAL FREQUENCY BAND QUADRIFILAR HELIX ANTENNA SYSTEMS AND METHODS

FIELD OF THE INVENTION

The present invention relates generally to antenna systems for user terminal handsets. More particularly, the present invention relates to quadrifilar helix antenna systems for use with mobile telephone user handsets.

BACKGROUND OF THE INVENTION

Cellular and satellite communication systems are well known in the art for providing a communications link between mobile telephone users and stationary users or other mobile users. These communications links may carry a variety of different types of information, including voice, data, video and facsimile transmissions. In typical cellular systems, wireless transmissions from mobile users are received by local, terrestrial based, transmitter/receiver stations. These local base stations or "cells" then retransmit the mobile user signals, via either the local telephone system or the cellular system, for reception by the intended receive terminals.

Many cellular systems rely primarily or exclusively on line-of-sight communications. In these systems, each local transmitter/receiver has a limited range, and consequently, a large number of local cells may be required to provide communications coverage for a large geographic area. The cost associated with providing such a large number of cells may prohibit the use of cellular systems in sparsely populated regions and/or areas where there is limited demand for cellular service. Moreover, even in areas where cellular service is not precluded by economic considerations, "black-out" areas often arise in terrestrial based cellular systems due to local terrain and weather conditions.

As such, it has been proposed to provide a combined, half-duplex, cellular/satellite communications network that integrates a limited terrestrial based cellular network with a satellite communications network to provide communications for mobile users over a large geographical area where it may be impractical to provide cellular service. In the proposed system, terrestrial based cellular stations would be provided in high traffic areas, while an L-Band satellite communications network would provide service to remaining areas. In order to provide both cellular and satellite communications, the user terminal handsets used with this system would include both a satellite and a cellular transceiver. Such a combined system could provide full communications coverage over a wide geographic area without requiring an excessive number of terrestrial cells.

In this proposed system, which is known as the Asian Cellular Satellite System, the satellite network would be implemented as one or more geosynchronous satellites orbiting approximately 22,600 miles above the equator. These satellites could provide spot beam coverage over much of the far east, including China, Japan, Indonesia and the Philippines. In this system, signals transmitted to the satellite will fall within the 1626.5 MHz to 1660.5 MHz transmit frequency band, and the signals transmitted from the satellite will fall within the 1525 MHz to 1559 MHz receive frequency band.

While integrating satellite and cellular service together in a dual-mode system may overcome many of the disadvantages associated with exclusively terrestrial based cellular systems, providing dual-mode user terminal handsets that meet consumer expectations regarding size, weight, cost, ease of use and communications clarity is a significant challenge. Consumer expectations relating to such physical characteristics and communications performance of handheld mobile phones have been defined by the phones used with conventional cellular systems, which only include a single transceiver that communicates with a cellular node which typically is located less than 20 miles from the mobile user terminal. By way of contrast, the handheld user terminals which will be used with the Asian Cellular Satellite System must include both a cellular and a satellite transceiver. Moreover, the large free space loss associated with the satellite communications aspect of the system may significantly increase the power and antenna gain which must be provided by the antenna for the satellite transceiver on the user terminal handset, as the signals transmitted to or from the satellites undergo a high degree of attenuation in traveling the 25,000 or more miles that typically separates the user handset from the geosynchronous satellites.

Furthermore, the satellite aspects of the network also may impose additional constraints on the user terminal handsets. For instance, the satellite transceiver provided with the user terminal handset preferably should provide a quasi-hemispherical antenna radiation pattern, in order to avoid the need to track a desired satellite. Additionally, the antenna which provides this quasi-hemispherical radiation pattern should transmit and receive a circularly polarized waveform, so as both to minimize the signal loss resulting from the arbitrary orientation of the satellite antenna on the user terminal with respect to the satellite and to avoid the effects of Faraday rotation which may result when the signal passes through the ionosphere. Moreover, the satellite antenna on the handheld transceiver should also have a low front-to-back ratio and low gain at small elevation angles in order to provide a low radiation pattern noise temperature. Additionally, as discussed above, the satellite network transmits signals in one frequency band (the transmit frequency subband) and receives signals in a separate frequency band (the receive frequency subband) in order to minimize interference between the transmit and receive signals. Thus the antenna on the handheld satellite transceiver preferably provides an acceptable radiation pattern across both the transmit and receive frequency subbands.

In light of the above constraints, there is a need for handheld satellite transceivers, and more specifically, antenna systems for such transceivers, capable of transmitting and receiving circularly polarized waveforms which provide a relatively high gain quasi-hemispherical radiation pattern over separate transmit and receive frequency subbands so as to be capable of receiving signals from, or transmitting signals to, satellites which may be located anywhere in the hemisphere. Moreover, given the handheld nature of the user terminals and consumer expectations of an antenna which is conveniently small for ease of portability, the satellite antenna system capable of meeting the aforementioned requirements should fit within an extremely small physical volume. These user imposed size constraints may also place limitations on the physical volume required by the antenna feed structure and any matching, switching or other networks required for proper antenna operation. Thus, for instance, in the Asian Cellular Satellite System, the satellite network link budgets require the satellite antenna system on the handheld phone to be capable of providing a net gain of at least 2 dBi over all elevation angles exceeding 45°, where the net gain is defined as the actual gain or "directivity" provided by the antenna minus any matching, absorption or other losses incurred in the antenna feed structure. Additionally, the antenna must also have an axial ratio of less than 3 dB while providing good front to back ratio over the entire receive frequency subband. These performance characteristics must be provided by an antenna which, along with any associated impedance matching circuits or other components, fits within a cylinder 13 centimeters in length and 13 millimeters in diameter.

Helix antennas, and in particular, multifilar helix antennas, are relatively small antennas that are well suited for various applications requiring circularly polarized waveforms and a quasi-hemispherical beam pattern. A helix antenna is a conducting wire wound in the form of a screw thread to form a helix. Such helix antennas are typically fed by a coaxial cable transmission line which is connected at the base of the helix. A multifilar helix antennas is a helix antenna which includes more than one radiating element. Each element of such a multifilar helix antenna is generally fed with an equal amplitude signal that is separated in phase by 360°/N, where N is the number of radiating antenna elements. As the phase separation between adjacent elements varies from 360°/N, the antenna pattern provided by the multifilar helix antenna tends to degrade significantly. Accordingly, the feed structure which couples the signals between the elements of a multifilar helix antenna and the transmitter/receiver preferably introduces minimal or no phase distortions so that such degradation of the antenna pattern is minimized or prevented.

A common type of multifilar helix antenna is the quadrifilar helix. The quadrifilar helix antenna is a circularly polarized antenna which includes four orthogonal radiating elements arranged in a helical pattern (which may be fractional turn), which are excited in phase quadrature (i.e., the radiated energy induced into or from the individual radiating elements is offset by 90° between adjacent radiating elements).

Quadrifilar helix antennas can be operated in several modes, including axial mode, normal mode or a proportional combination of both modes. To achieve axial mode operation, the axial length of each antenna element is typically several times larger than the wavelength corresponding to the center frequency of the frequency band over which the antenna is to operate. Operated in this mode, a quadrifilar helix antenna can provide a relatively high gain radiation pattern. However, such a radiation pattern is highly directional (i.e., it is not quasi-hemispherical) and hence axial mode operation is typically not appropriate for satellite communications terminals that do not include means for tracking the satellite.

Operated in the normal mode, each helix of a quadrifilar helix antenna is typically balun fed at the top, and the helical arms are typically of resonant length (i.e., $\frac{1}{4}\lambda$, $\frac{1}{2}\lambda$, $\frac{3}{4}\lambda$ or $\lambda$ in length, where $\lambda$ is the wavelength corresponding to the center frequency of the frequency band over which the antenna is to operate). These elements are wound on a small diameter with a large pitch angle. In this mode, the antenna typically provides the quasi-hemispherical radiation pattern necessary for mobile satellite communications, but unfortunately, the antenna only provides this gain over a relatively narrow bandwidth situated about the resonant frequency. Moreover, the natural bandwidth of the antenna is proportional to the diameter of the cylinder defined by the quadrifilar helix antenna, and thus, all else being equal, the smaller the antenna the smaller the operating bandwidth. As discussed above, certain emerging cellular and satellite phone applications have relatively large transmit and receive operating bandwidths. These bandwidths may approach or even exceed the bandwidth provided by quadrifilar helix antennas operated in normal mode, and this is particularly true where other system requirements significantly restrict the maximum diameter of the antenna.

Quadrifilar antennas have previously been used in a number of mobile L-Band satellite communication applications, including INMARSAT, NAVSTAR, and GPS. However, nearly all these prior art antennas were physically much too large to satisfy the size requirements of emerging satellite phone applications. Moreover, these prior art antennas also generally do not meet the size constraints imposed by these emerging applications while also providing the gain, axial ratio, noise temperature, front-to-back ratio and broadband performance that are required by these emerging applications. Accordingly, a need exists for a new, significantly smaller, satellite phone antenna system that is capable of providing a quasi-hemispherical antenna pattern with positive gain over separate transmit and receive frequency subbands.

SUMMARY OF THE INVENTION

In view of the above limitations associated with existing antenna systems, it is an object of the present invention to provide physically small quadrifilar helix antenna systems for satellite and cellular phone networks.

Another object of the present invention is to provide a quadrifilar helix antenna system capable of providing a radiation pattern with a positive gain, quasi-hemispherical radiation pattern at separate transmit and receive frequency subbands.

It is still a further object of the present invention to provide a quadrifilar helix antenna system for satellite and cellular phones that has a simplified feed structure and that minimizes the phase distortions introduced in the feed network.

These and other objects of the present invention are provided by antenna systems which use switched concentric transmit and receive quadrifilar helix antennas to provide half-duplex communications over separate transmit and receive frequency bands. These antenna systems capitalize on the size, gain, polarization, and radiation pattern characteristics achievable with quadrifilar helix antennas, while avoiding the bandwidth limitations of such antennas, through the use concentrically arranged, yet decoupled, transmit and receive antennas.

In a preferred embodiment of the present invention, concentrically arranged transmit and receive quadrifilar helix antennas are provided, each of which comprise two bifilar helices arranged orthogonally and excited in phase quadrature. These antennas are each associated with coupling means, which electrically connect the transmit and receive antennas to the transmitter and receiver, respectively. Also provided are a pair of disconnecting means, the first of which electrically isolates the transmit quadrifilar helix antenna from the receiver when the user terminal is in receive mode, and the second of which similarly isolates the receive quadrifilar helix antenna from the transmitter during periods of transmission. These antenna disconnecting means may comprise a plurality of switching means interposed along each electrical connection between each quadrifilar helix antenna and the transmitter/receiver. Such switches could comprise PIN diodes, gallium arsenide field effect transistors, or other electrical, electrical mechanical, or mechanical switching mechanisms known to those of skill in the art.

In another embodiment of the present invention, the antenna coupling means comprise 90° hybrid couplers. In this embodiment, the transmit and receive quadrifilar helix antennas each may comprise a first filar coupled at its origin to one of the output ports on the antennas respective 90° hybrid coupler, a second filar coupled at its origin to the other output port of the 90° hybrid coupler, and third and fourth filars which are coupled at their origin to a reference voltage, and wherein the first and third filars and the second and fourth filars are electrically connected at their distal ends. In this embodiment, the quadrature input to these 90° hybrid couplers is also typically connected to the reference voltage through a 50 ohm resistor.

In yet another embodiment of the present invention, the transmit quadrifilar helix antenna is substantially disposed within the cylinder which is defined by the radiating elements of the receive quadrifilar helix antenna. In this embodiment, the bifilar helices forming the transmit quadrifilar helix antenna may be radially aligned with the bifilar helices forming the receive quadrifilar helix antenna. In another aspect of the present invention, both the transmit and receive quadrifilar helix antennas are configured to transmit/receive right hand circularly polarized signals. Furthermore, each of these filar helices may comprise a helix with a pitch angle from about 55 to 85 degrees.

Thus, the antenna systems of the present invention comprise switched, concentrically arranged transmit and receive quadrifilar helix antennas which provide half-duplex communications over separate transmit and receive frequency bands. These antenna systems provide the gain, bandwidth, polarization, and radiation pattern characteristics necessary for emerging mobile satellite communications applications, in a physical package which is conveniently small and meets consumer expectations relating to ease of portability.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, while the antenna systems of the present invention are particularly advantageous for use in certain satellite communications applications, it will be understood by those of skill in the art that these antenna systems may be advantageously used in a variety of applications, including cellular, terrestrial based communications systems, and thus the present invention should not be construed as limited in any way to antenna systems for use with satellite communication terminal handsets. Like numbers refer to like elements throughout.

Figure 1:
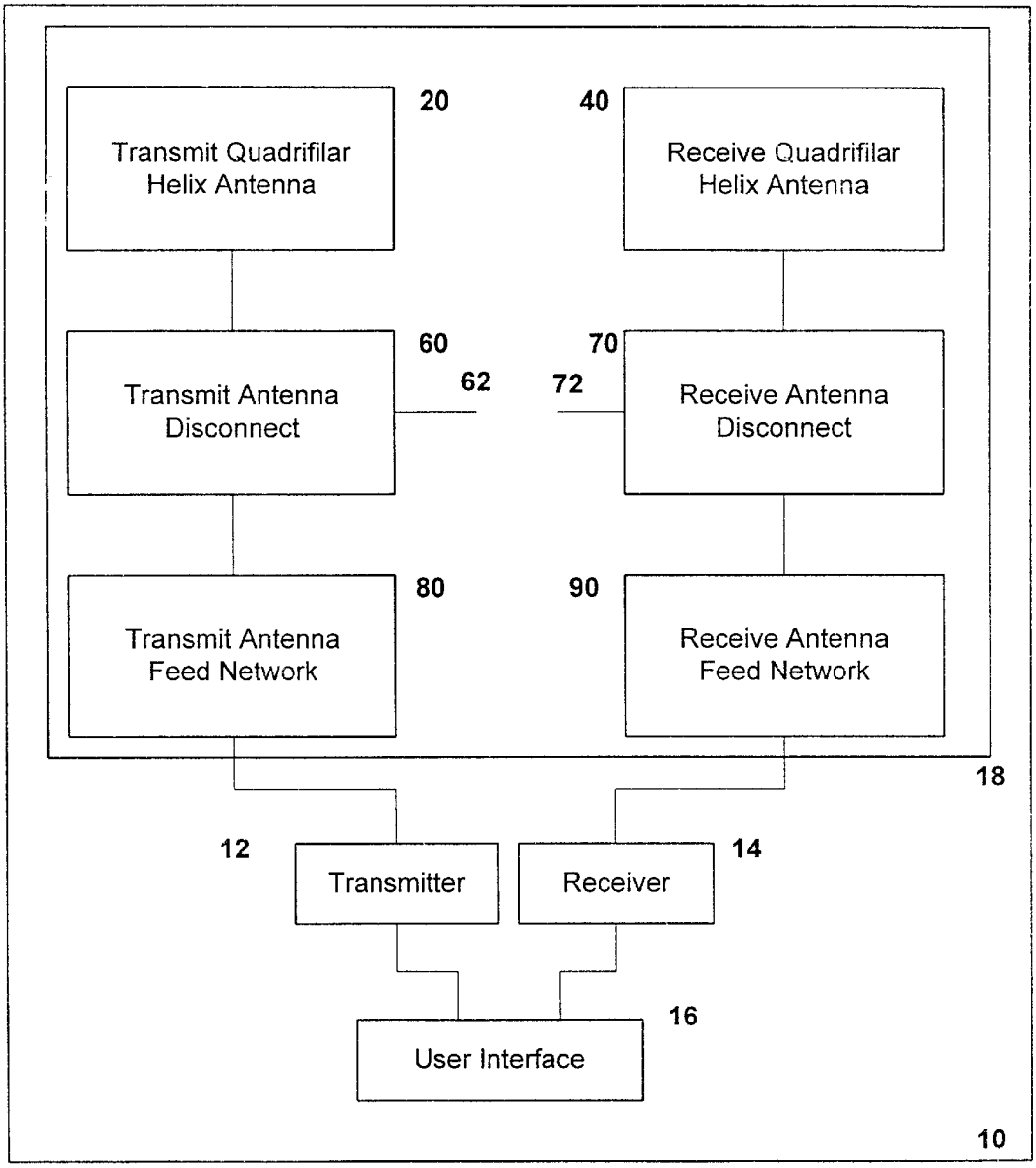
FIG. 1 is a block diagram of a quadrifilar helix antenna system capable of operating over two frequency bands according to the present invention.

An embodiment of a handheld wireless communications terminal 10 according to the present invention is illustrated in FIG. 1. Terminal 10 generally comprises an antenna system 18, a transmitter 12, a receiver 14 and a user interface 16. As illustrated in FIG. 1, the antenna system 18 of the handheld terminal 10 employs dual quadrifilar helix antennas 20, 40 to provide for dual band, half-duplex wireless communications. In a preferred embodiment, antenna system 100 incorporates concentric, substantially overlapping quadrifilar helix antennas 20, 40 which are each fed by a single 90° hybrid coupler 81, 91 (not shown in FIG. 1) to provide a physically small, cost effective antenna system capable of meeting the stringent gain, bandwidth, radiation pattern and other requirements of emerging cellular/satellite phone applications.

As depicted in FIG. 1, the dual frequency band quadrifilar helix antenna system 100 according to the present invention employs two separate quadrifilar helix antennas, transmit antenna 20 and receive antenna 40. Each antenna 20, 40 is coupled to an antenna feed network 80, 90. The transmit feed network 80 feeds a source signal from transmitter 12 to the individual elements of the transmit quadrifilar helix antenna 20, whereas the receive feed network 90 combines the signal received by the individual elements of receive quadrifilar helix antenna 40 and feeds this combined signal to receiver 14. Additionally, antenna disconnecting means 70 are provided between receive feed network 90 and receive antenna 40. These disconnecting means 70 are used to electrically isolate the receive antenna 40 from the transmit network 20, 60, 80, 12 during periods of transmission. Similarly, switching means 60 are also provided between transmit feed network 80 and transmit antenna 20, which electrically isolate the transmit antenna 20 when the handset 10 is operating in receive mode.

The antenna system depicted in FIG. 1 operates as follows. When the user handset 10 is in the receive mode, bias signal 62 is activated which excites the disconnect means 60 in the transmit antenna 20 feed path, thereby open circuiting the elements of the transmit antenna 20 in order to electrically isolate transmit antenna 20 from receive antenna 40. Similarly, when user handset 10 operates in the transmit mode, bias signal 72 is activated, which excites disconnect means 70 in the receive antenna 40 path in order to electrically isolate receive antenna 40 from transmit antenna 20. As will be understood by those of skill in the art, transmit and receive disconnect means 60, 70 need not actually provide a true open circuit in order to effectively electrically isolate the antenna which is not in use; they simply need to provide sufficient impedance such that only a minimal amount of energy is coupled into the "OFF" antenna. Various means of providing such an open circuit are known to those of skill in the art, such as reverse biased PIN diodes, Gallium arsenide field effect transistors, and various other electrical, electromechanical and mechanical switching mechanisms.

Figure 2:
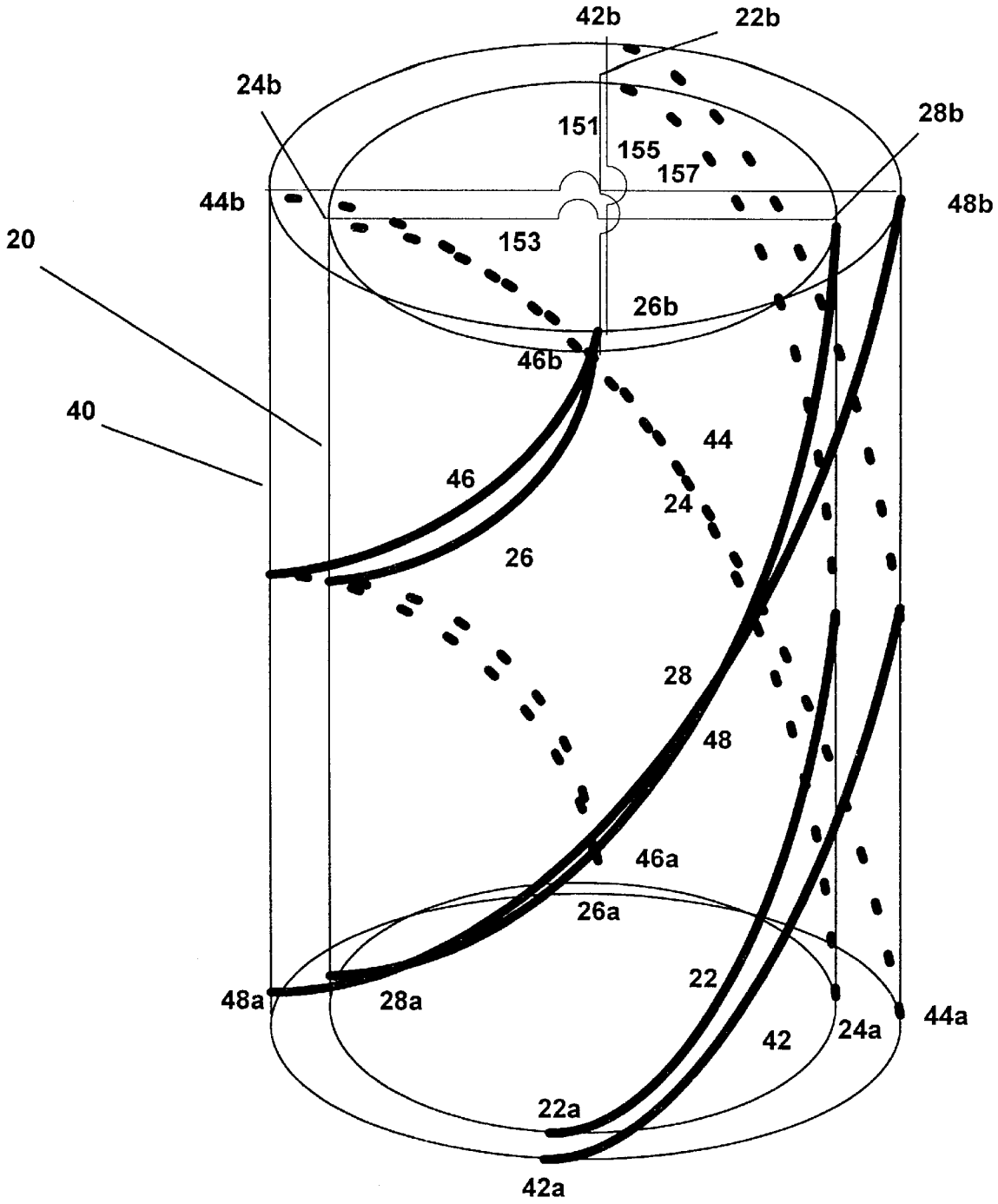
FIG. 2 is a perspective view of a pair of concentric transmit and receive quadrifilar helix antennas according to the present invention.

As illustrated in FIG. 2, transmit and receive quadrifilar helix antennas 20, 40 are each comprised of four radiating helical antenna elements 22, 24, 26, 28; 42, 44, 46, 48 or "filars". A filar is typically implemented as a wire or strip, such as 22, wrapped in a helical shape along the length of a coaxial supporting tube, thereby defining a cylinder of a constant diameter and a height equal to the axial length of the antenna elements which comprise each antenna. Thus each antenna 20, 40 comprises a pair of bifilar helices. In a preferred embodiment, the elements 22, 24, 26, 28; 42, 44, 46, 48 of each quadrifilar helix antenna 20, 40 are excited in phase quadrature and are physically spaced from each other by 90°. Note that as used herein, it is intended that the word "helix" not imply a plurality of turns. In particular, a "helix" as used herein may constitute less than one full turn.

Alternative embodiments within the scope of the present invention include transmit and/or receive quadrifilar helix antennas 20, 40 having radiating elements 22, 24, 26, 28; 42, 44, 46, 48 which are helical in the sense that they each form a coil or part coil around an axis, but also change in diameter from one end to the other. Thus, while the preferred embodiment of the transmit and receive antennas 20, 40 have helical elements defining a cylindrical envelope, it is possible to implement one or both of these antennas to have elements defining instead a conical envelope or another surface of revolution.

The twist of the individual helices 22, 24, 26, 28; 42, 44, 46, 48 may be right hand or left hand, where each element 22, 24, 26, 28; 42, 44, 46, 48 comprising a particular antenna 20, 40 has the same direction of twist. Where antennas 20, 40 are origin fed in endfire mode, by IEEE and industry conventions, a left hand twist is generally used to receive and transmit right hand circularly polarized waveforms, whereas a right hand twist generally is used to receive and transmit left hand circularly polarized waveforms. In a preferred embodiment of the present invention, both the transmit and receive quadrifilar helix antennas 20, 40 are configured to transmit and receive like polarized waveforms.

The radiation pattern provided by each of the quadrifilar helix antennas 20, 40 depicted in FIG. 2 is primarily a function of the helix diameter, pitch angle (which is a function of the number of turns per unit axial length of the helix) and the actual length of the elements which comprise the antenna. In a preferred embodiment of the present invention, the helical antenna elements of both the transmit and receive antennas 20, 40 are each approximately $\lambda/2$ in electrical length, where $\lambda$ is the wavelength corresponding to the center frequency of the transmit (for transmit antenna 20) or receive (for receive antenna 40) frequency band. In this embodiment, antennas 20, 40 preferably have pitch angles from about 55 to 85 degrees. In this preferred range, the lower pitch angles provide more hemispherical coverage, while the higher pitch angle values concentrate the radiation pattern (and hence provides greater directivity) over a smaller solid angle than hemispherical coverage for element lengths on the order of ½ wavelength. Given the specific requirements of the system in which the antennas are to be used, a judicious choice of pitch angle may be made to provide the optimum tradeoff between coverage and directivity. These quadrifilar helix antennas 20, 40 operate in standing wave mode, providing a quasi-hemispherical radiation pattern (or perhaps a slightly more directional pattern) for a relatively narrow bandwidth about the resonant frequency. However, by providing separate transmit and receive quadrifilar helix antennas 20, 40, it is possible to use the quadrifilar helix antenna systems of the present invention in mobile satellite communications applications with widely separated transmit and receive frequency subbands.

Figure 3:
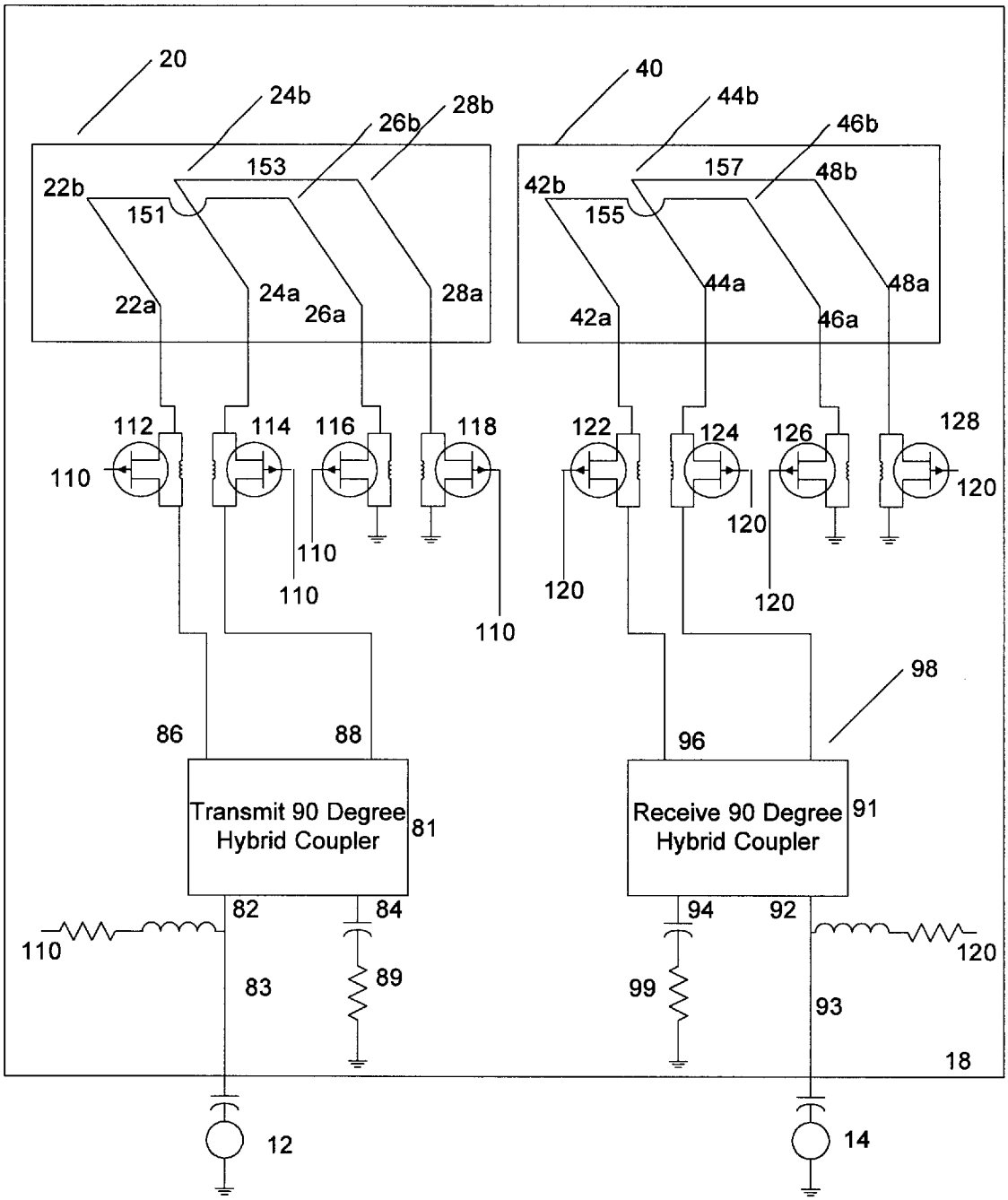
FIG. 3 is a schematic diagram illustrating specific embodiments of the antennas, coupling networks and disconnecting mechanisms of the present invention.

The four individual antenna elements 22, 24, 26, 28; 42, 44, 46, 48 that comprise transmit and receive quadrifilar helix antennas 20, 40 each have an origin which is the end proximate the feed networks, and a distal end. As indicated best in FIG. 3, the distal ends 22*b*, 26*b* of transmit quadrifilar helix antenna elements 22 and 26 are electrically connected via wire or strip 151 to form a bifilar loop, with the origin 22*a* of element 22 connected to the transmit feed network 80 (which in FIG. 3 is implemented as 90° hybrid coupler 81) and the origin 26*a* of element 26 coupled to ground. Similarly, the distal ends 24*b*, 28*b* of elements 24 and 28 are electrically connected via wire or strip 153 to form a second bifilar loop, with the origin 24*a* of element 24 connected to the second output of the transmit feed network and the origin 28*a* of element 28 coupled to ground. This embodiment of quadrifilar helix antenna 20 is referred to as a closed loop embodiment, as the elements of the antenna are electrically connected at their distal ends. These are to be distinguished from open-loop quadrifilar helix antennas, which comprise four helical elements each of which is open-circuited at its distal end.

In a preferred embodiment of transmit antenna 20, bifilar loops 22, 26; 24, 28 are symmetrical. Accordingly, electrical connections 151, 153 are preferably implemented as identically shaped conductive wires or strips arranged so as to provide the short-circuits which form bifilar loops 22, 26; 24, 28 while electrically isolating bifilar loop 22, 26 from bifilar loop 24, 28. Such a symmetrical arrangement of electrical connections 151, 153 minimizes the variation in phase between adjacent elements from the ideal phase offset of 90°.

Similarly, on receive quadrifilar helix antenna 40, the distal ends 42*b*, 46*b* of elements 42 and 46 are electrically connected via wire or strip 155 to form a first bifilar loop, and the distal ends 44*b*, 48*b* or elements 44 and 48 are electrically connected via wire or strip 157 to form a second bifilar loop. The origin 42*a*, 44*a* of elements 42 and 44 are coupled to receive feed network 90 (which in FIG. 3 is implemented as 90° hybrid coupler 91), and the orgins 46*a*, 48*a* of elements 46 and 48 are connected to ground. Both the transmit and receive antennas 20, 40 may additionally include a radome. In the preferred embodiment, this radome is a plastic tube with an end cap.

The closed loop embodiment of the quadrifilar helix antenna of the present invention solves a problem that may arise when open loop quadrifilar helix antennas are used in mobile phone applications. Specifically, in applications which require a small antenna diameter, a bottom-fed ½ wavelength open loop antenna has a nearly open circuit impedance (1000 ohms or more) at the resonant frequency. Such an impedance may be too large to transform to the desired impedance, which is often on the order of 50 ohms as the antennas are typically connected to transmitter 12 and receiver 14 via one or more 50 ohm impedance coaxial cables, and thus maximum power transfer may not be obtainable as the impedance of the antennas cannot be matched to the impedance of the source transmission line. The resonant resistance of the closed loop bottom-fed $\lambda/2$ length element quadrifilar helix antenna, on the other hand, is in the region of 4–12 ohms. This may be transformed to the order of 50 ohms to match the impedance of the transmission source by known impedance transformation techniques, such as a radio frequency transformer. However, for certain element lengths other than ½ wavelength, such as ¾ wavelength elements, the open circuit impedance may be much lower so as to be transformable to the order of 50 ohms.

Figure 4:
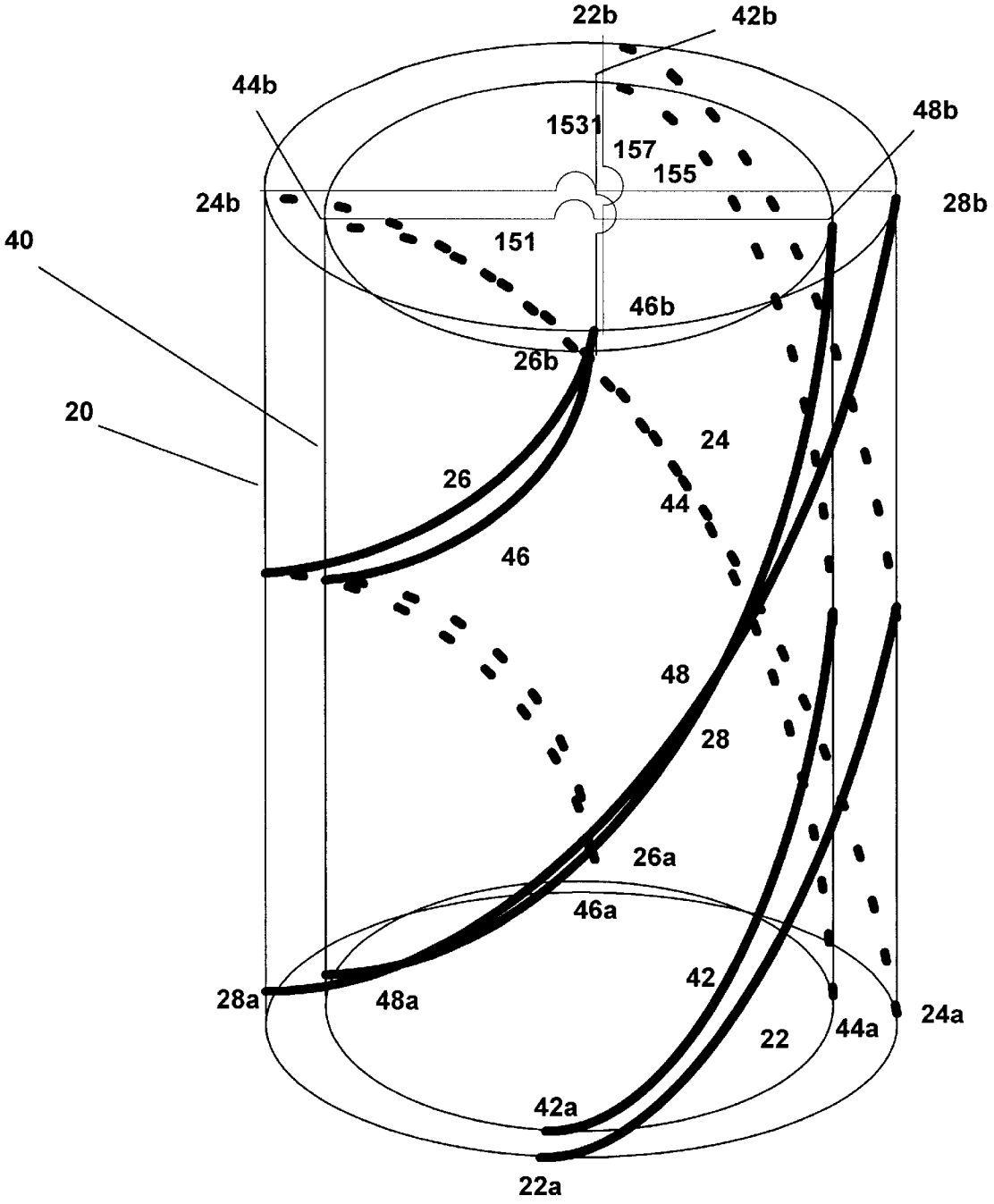
FIG. 4 is a perspective view of a pair of concentric transmit and receive quadrifilar helix antennas according to the present invention with the receive quadrifilar helix antenna disposed within the cylinder defined by the transmit quadrifilar helix antenna.

As shown in FIG. 2, in the preferred embodiment of the present invention, the transmit and receive quadrifilar helix antennas 20, 40 are concentrically arranged in an overlapping relationship. This can minimize the physical volume of the antenna system 18. Typically, the receive frequency band encompasses lower frequencies than the transmit frequency band. As such, in the preferred embodiment, the antenna elements 22, 24, 26, 28 forming the transmit quadrifilar helix antenna 20 are shorter than the elements 42, 44, 46, 48 on the receive quadrifilar helix antenna 40 and a similar antenna radiation pattern can be achieved with a smaller antenna diameter. Thus, in this case, the transmit antenna 20 is typically disposed within the cylinder defined by the receive quadrifilar helix antenna 40. However, as illustrated in FIG. 4, antenna system 10 may also be designed so that receive quadrifilar helix antenna 40 is disposed within the cylinder defined by the transmit quadrifilar helix antenna 20. As shown in FIG. 2, in the preferred embodiment, the elements 22, 24, 26, 28; 42, 44, 46, 48 of transmit and receive quadrifilar helix antennas 20, 40 are radially aligned. Such radial alignment serves to minimize couplings between the "ON" and "OFF" antennas.

The elements 22, 24, 26, 28; 42, 44, 46, 48 of transmit and receive quadrifilar helix antennas 20, 40 are preferably comprised of a continuous strip of electrically conductive material such as copper. These radiating elements 22, 24, 26, 28; 42, 44, 46, 48 may be printed on a flexible, planar dielectric substrate such as fiberglass, TEFLON, polyimide or the like via etching, deposition or other conventional methods. This flexible dielectric base may then be rolled into a cylindrical shape, thereby converting the linear strips into helical antenna elements 22, 24, 26, 28; 42, 44, 46, 48. However, while the technique of forming a quadrifilar helix antenna described above is the preferred method, it will be readily apparent to those of skill in the art that transmit and receive quadrifilar helix antennas 20, 40 may be implemented in a variety of different ways, and that a cylindrical support structure is not even required.

As indicated in FIG. 1, transmit and receive feed networks 80, 90 are provided to phase split the energy for radiation in the transmit mode and for combining the received radiated energy in receive mode. These feed networks 80, 90 can be implemented as any of a variety of known networks for feeding a quadrifilar helix antenna, such as the combination of a hybrid coupler and two symmetrizer modules disclosed in U.S. Pat. No. 5,255,005 to Terret et al.

Quadrifilar helical antennas such as antennas 20, 40 are known to be capable of radiating right or left hand circularly polarized signals when fed from the top in a backfire mode, fed in the middle via a selectable up or down mode, or when bottom fed in a forward fire reverse twist mode. However, top fed versions tend to require sleeve baluns in the center of the cylindrical structure, which may be difficult to fabricate. This is particularly true at the frequencies required by microwave satellite phone user terminals, due to the small diameter of the helical antenna structure required by such phones. Similarly, center fed quadrifilar helical antennas may also be difficult to fabricate. In a preferred embodiment, this invention solves these fabrication problems by using origin-fed networks which drives the two closed bifilar wavelength loops on each quadrifilar helix antenna 20, 40.

Such a preferred embodiment of the feed networks 80, 90 is depicted in FIG. 3. As shown in FIG. 3, each of the feed networks 80, 90 is implemented as a 90° hybrid coupler 81, 91 which is coupled to the bifilar loops which form the transmit and receive antennas 20, 40. As illustrated in FIG. 3, the transmit feed network 80 comprises a single 90° hybrid coupler 81, with inputs 82, 84 and outputs 86, 88. Input 82 is coupled to the transmission signal source 12 and input 84 is coupled to ground through a resistive termination 89.

Typically, the transmission signal source 12 is coupled to the transmit 90° hybrid coupler 81 through a coaxial cable 83. Coaxial cable typically has an impedance of approximately 50 ohms. In order to maximize the energy transfer from the transmission signal source 12 to the transmit quadrifilar helix antenna 20, it is preferable to match the impedance of the transmission source 12 and the impedance of the transmit antenna 20. Such matching can be accomplished by using known techniques to raise the impedance of antenna elements 22, 24 to approximately 50 ohms, and implementing resistor 89 as a 50 ohm resistor. As the $\lambda/2$ length antenna elements 22, 24, 26, 28 implemented in a preferred embodiment of the present invention have a resistance of approximately 4–12 ohms at resonance, an impedance transformation of approximately a factor of four is necessary to match the impedance of the transmit quadrifilar helix antenna 20 to the impedance at the input of the transmit 90° hybrid coupler 81. Those of skill in the art will recognize that there are a variety of techniques which can be used to accomplish this impedance transformation, such as the use of a radio frequency balun with a four-to-one impedance transformation or a variety of small surface mount radio frequency transformers.

As illustrated best in FIG. 3, transmit 90° hybrid coupler 81 divides the input source signal into two, equal amplitude output signals, which are offset from each other by 90° in phase. Output 86 is coupled to the first of the two $\lambda$ long bifilar loops 22, 26 which comprise the transmit quadrifilar helix antenna 20, and output 88 feeds the second $\lambda$ long bifilar loop 24, 28.

As also is illustrated in FIG. 3, the receive feed network 91 is preferably implemented in the exact same manner as the transmit feed network 81, except that the receive feed network 91 is used to combine and deliver induced power to the receiver 14 as opposed to delivering a signal to the antenna for radiation. Accordingly, a receive 90° hybrid coupler 91 having input ports 96, 98 and output ports 92, 94 is used to combine the energy received by receive quadrifilar helix antenna 40 and deliver this induced power to receiver 14. Input port 96 of the receive 90° hybrid coupler 91 is coupled to the first bifilar loop 42, 46 of receive quadrifilar helix antenna 40, and port 98 is coupled to the second bifilar loop 44, 48. Output 92 of the receive 90° hybrid coupler is coupled to the receiver 14 through a coaxial cable 93, and output port 94 is coupled to ground through resistor 99.

As will be readily understood by those of skill in the art, 90° hybrid couplers 81 and 91 can be implemented in a variety of different ways, such as distributed quarter wave transmission lines or as lumped element devices. In the preferred embodiment, lumped element 90° hybrid splitter/combiners are used as they are typically smaller than corresponding distributed branch line couplers and also maintain a phase difference of almost exactly 90° between their two output ports.

FIG. 3 also illustrates a preferred method of electrically coupling transmit and receive quadrifilar helix antennas 20, 40 to their respective feed networks 80, 90. As discussed above, in the preferred embodiment both the transmit and receive antennas 20, 40 are implemented as a pair of wavelength ($\lambda$) long, electrically connected, bifilar loops. As shown in FIG. 3, transmit and receive antennas 20, 40 are fed by connecting $\lambda$ long loops 22, 26; 42, 46 to the 0° input/output of their respective 90° hybrid couplers 81, 91 and coupling the other bifilar loop 24, 28; 44, 48 to the other input/output of the respective 90° hybrid coupler. The origins of elements 26, 28 of the transmit and quadrifilar helix antenna 20, 40, as well as the origins of elements 46, 48 of the receive quadrifilar helix antenna are coupled to electrical ground. In this manner, during transmission each element of the transmit and receive quadrifilar helix antennas 20, 40 are excited in phase quadrature by equal amplitude signals.

As shown in FIG. 2, in the preferred embodiment, transmit and receive quadrifilar helix antennas 20, 40 are implemented in a concentric, substantially overlapping arrangement. While this arrangement minimizes the physical dimensions of the antenna system, the close proximity of the transmit antenna elements 22, 24, 26, 28 and the receive antenna elements 42, 44, 46, 48 provides the possibility that received energy may be coupled in the transmit antenna 20 or that energy induced into transmit antenna 20 may be coupled into receive antenna 40. Such coupling may be undesirable because it reduces the power that is transferred to transmit antenna 20 for transmission or that is received from receive antenna 40. Moreover, the coupling also can adversely impact the radiation patterns of the antennas.

According to the present invention, it has been discovered that transmit and receive quadrifilar helix antennas 20, 40 can be effectively electrically isolated by open-circuiting the elements of the "OFF" antenna. When such an open-circuit is provided, the "ON" antenna essentially operates as if the "OFF" antenna was not present. In the preferred embodiment of the present invention, the "OFF" antenna is open circuited via switching means 112, 114, 116, 118; 122, 124, 126, 128 which are coupled to each of the elements of transmit and receive quadrifilar helix antennas 20, 40 at the element origins. These switches are activated by a bias signal to provide an open circuit at the origin of each element 22, 24, 26, 28 of transmit antenna 20 when user terminal 10 is in the receive mode, and to provide an open circuit at the origin of each element 42, 44, 46, 48 of receive antenna 40 when the user terminal 10 is in the transmit mode.

As will be understood by those of skill in the art, switching means 112, 114, 116, 118; 122, 124, 126, 128 can be provided by various electrical, electro-mechanical, or mechanical switches. However, electrical switches are preferred, due to their reliability, low cost, small physical volume and ability to switch on and off at the high speeds required by emerging digital communications modes of operation. These electrical switches can readily be implemented as small surface mount devices on a microelectronic substrate such as a stripline or microstrip printed circuit board. Preferably, a single microelectronic substrate contains both these switches and the components comprising the transmit and receive feed networks. In one embodiment of the present invention, switching means 112, 114, 116, 118; 122, 124, 126, 128 are implemented as PIN diodes.

A PIN diode is a semiconductor device that operates as a variable resistor over a broad frequency range from the high frequency band through the microwave frequency bands. These diodes have a very low resistance, of less than 1 ohm, when in a forward bias condition. Alternatively, these diodes may be zero or reverse biased, where they behave as a small capacitance of approximately one picofarad shunted by a large resistance of as much as 10,000 ohms. Thus, in forward bias mode, the PIN diode acts as a short-circuit, while in reverse bias mode, the PIN diode effectively acts as an open-circuit. In this embodiment, the PIN diodes are implemented as discrete components coupled to the origin of each element of the transmit and receive quadrifilar helix antennas 20, 40.

In the PIN diode embodiment, when the communications handset 10 is in receive mode, a D.C. bias current is applied to each PIN diode in the transmit circuit branch where it reverse biases these diodes thereby creating an open circuit at the origin of each element 22, 24, 26, 28 of quadrifilar helix antenna 20. At the same time, a forward bias current is applied to the PIN diodes in the receive circuit branch creating a lower resistance connection to the receive circuit branch. Consequently, the receive circuit branch PIN diodes operate in forward bias mode, thereby coupling the elements 42, 44, 46, 48 of receive quadrifilar helix antenna 40 to receiver 14. As will readily be understood by those of skill in the art, when communications terminal 10 is operating in transmit mode, a zero or reverse bias signal is applied to the PIN diodes in the receive circuit branch and a forward bias is applied to the PIN diodes in the transmit circuit branch, thereby coupling antenna 20 to transmitter 12 and creating an open-circuit at the origin of quadrifilar helix antenna 40.

In an alternative embodiment shown in FIG. 3, Gallium arsenide field effect transistors (GaAs FETs) are used instead of PIN diodes to implement switches 112, 114, 116, 118; 122, 124, 126, 128. These devices may be preferred over PIN diodes because they operate in reverse bias mode when a bias signal is absent, thereby avoiding the power drain inherent with PIN diodes which require a bias current for forward bias operation. Moreover, as shown in FIG. 3, each GaAs FET uses an inductor to anti-resonate and therefore isolate the switch in the "OFF" mode. This operation significantly increases the electrical isolation of the "OFF" circuits. In the "ON" mode, the inductor is rendered desirably ineffective as it is effectively shorted by the "ON" resistance of the associated GaAs FET. Furthermore, the drains and sources of the GaAs FET switches are operated at direct current ground potential and resistance. This attribute renders these GaAs FET free from ordinary electrostatic discharge concerns typically associated with use of GaAs FET near antenna circuitry. In this embodiment, the GaAs FET switches 112, 114, 116, 118; 122, 124, 126, 128 are implemented as surface mount components on the stripline printed circuit board containing transmit and receive 90° hybrid couplers 81, 83.

In a preferred embodiment, the 90° hybrid coupler 81, 50 ohm resistor 89, and GaAs FET switches 112, 114, 116, 118 of the transmit branch are implemented as surface mount components on a stripline or microstrip printed circuit board. Preferably, a multilayer board is used which includes a ground circuit between its top and bottom layers. At one end of the printed circuit board, four contacts may be provided to couple the feed network to the elements of the transmit quadrifilar helix antenna 20. On the other end of the printed circuit board, provision may be made for attaching the coaxial transmission line from transmitter 12. In this case, the identical surface mount components of the receive branch are preferably mounted on the opposite side of the printed circuit board.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the antenna system other than those explicitly described herein without going beyond the scope of the present invention.

That which is claimed is:

1. A half-duplex antenna system for providing electrical signals to a receiver and for transmitting electrical signals from a transmitter, comprising:

a receive quadrifilar helix antenna comprising two bifilar helices arranged orthogonally and excited in phase quadrature;

a transmit quadrifilar helix antenna comprising two bifilar helices arranged orthogonally and excited in phase quadrature, positioned concentrically with said receive quadrifilar helix antenna;

first coupling means for coupling the signal from said receive quadrifilar helix antenna to said receiver;

first disconnecting means for electrically isolating the bifilar helices of said transmit quadrifilar helix antenna from said receiver during periods of transmission;

second coupling means for coupling the signal from said transmitter to said transmit quadrifilar helix antenna; and second disconnecting means for electrically isolating the bifilar helices of said receive quadrifilar helix antenna from said transmitter when the antenna system is operating in the receive mode; and wherein one of said transmit quadrifilar helix antenna and said receive quadrifilar helix antenna is disposed within the cylinder defined by the other of said transmit quadrifilar helix antenna and said receive quadrifilar helix antenna.

2. The antenna system of claim 1, wherein said first disconnecting means comprises a plurality of switching means interposed along each electrical connection between said transmitter and said transmit quadrifilar helix antenna, and wherein said second disconnecting means comprises a plurality of switching means interposed along each electrical connection between said receiver and said receive quadrifilar helix antenna.

3. The antenna system of claim 2, wherein said switching means comprise PIN diodes.

4. The antenna system of claim 2, wherein said switching means comprise gallium arsenide field effect transistors.

5. The antenna system of claim 1, wherein said first coupling means comprises a first 90° hybrid coupler having first and second input ports and first and second output ports and said second coupling means comprises a second 90° hybrid coupler having first and second input ports and first and second output ports.

6. The antenna system of claim 5, wherein said transmit quadrifilar helix antenna comprises a first filar coupled at its origin to the first output port on said first 90° hybrid coupler, a second filar coupled at its origin to the second output port of said first 90° hybrid coupler, and third and fourth filars coupled at their origin to a first reference voltage, and wherein said first and third filars are electrically connected at their distal ends and said second and fourth filars are electrically connected at their distal ends; and wherein said receive quadrifilar helix antenna comprises a first filar coupled at its origin to the first output port on said second 90° hybrid coupler, a second filar coupled at its origin to the second output port of said second 90° hybrid coupler, and third and fourth filars coupled at their origin to said first reference voltage, and wherein said first and third filars are electrically connected at their distal ends and said second and fourth filars are electrically connected at their distal ends.

7. The antenna system of claim 5, wherein said first and second 90° hybrid couplers comprise lumped element 90° hybrid couplers.

8. The antenna system of claim 1, wherein said transmit antenna is configured to transmit a right hand circularly polarized signal and wherein said receive antenna is configured to receive a right hand circularly polarized signal.

9. The antenna system of claim 1, wherein each of said filar helices comprises a helix with a pitch angle greater than about 55 degrees and less than about 85 degrees.

10. The antenna system of claim 1, further comprising at least one microelectronic substrate, and wherein said transmit quadrifilar helix antenna, said receive quadrifilar helix antenna and said first and second coupling/disconnect means are implemented on said at least one microelectronic substrates.

11. The antenna system of claim 1, wherein the bifilar helices forming said transmit quadrifilar helix antenna are radially aligned with the bifilar helices forming said receive quadrifilar helix antenna.

12. A half-duplex antenna system for providing electrical signals to a receiver and for transmitting electric signals from a transmitter, comprising:

a transmit 90° hybrid coupler having two output ports fed by said transmitter;

a receive 90° hybrid coupler having two input ports feeding said receiver;

concentric transmit and receive quadrifilar helix antennas, each comprising two bifilar helices arranged orthogonally and excited in phase quadrature;

wherein one of said transmit quadrifilar helix antenna and said receive quadrifilar helix antenna is disposed within the cylinder defined by the other of said transmit quadrifilar helix antenna and said receive quadrifilar helix antenna;

wherein the bifilar helices comprising said transmit quadrifilar helix antenna each comprise a first filar coupled at its origin to one of the output ports on said transmit 90° hybrid coupler and a second filar coupled at its origin to ground, and wherein said first and second filar helices are electrically connected at their distal ends, and wherein the bifilar helices comprising said receive quadrifilar helix antenna each comprise a first filar coupled at its origin to one of the input ports on said receive 90° hybrid coupler and a second filar coupled at its origin to ground, and wherein said first and second filar helices are electrically connected at their distal ends;

first disconnecting means for electrically isolating the bifilar helices of said transmit quadrifilar helix antenna from said receiver; and second disconnecting means for electrically isolating the bifilar helices of said receive quadrifilar helix antenna from said transmitter.

13. The antenna system of claim 12, wherein said first antenna disconnecting means comprises a plurality of switching means interposed along each electrical connection between said transmitter and said transmit quadrifilar helix antenna and wherein said second antenna disconnecting means comprises a plurality of switches interposed along each electrical connection between said receiver and said receive quadrifilar helix antenna.

14. The antenna system of claim 13, wherein said switching means comprise PIN diodes.

15. The antenna system of claim 13, wherein said switching means comprise gallium arsenide field effect transistors.

16. The antenna system of claim 12, wherein said first and second 90° hybrid couplers comprise lumped element 90° hybrid couplers.

17. The antenna system of claim 12, wherein said receive quadrifilar helix antenna defines a cylinder having a first radius, and wherein said transmit quadrifilar helix antenna defines a cylinder having a second radius, wherein said transmit quadrifilar helix antenna is disposed within the cylinder defined by said receive quadrifilar helix antenna, and wherein the bifilar helices forming said transmit quadrifilar helix antenna are radially aligned with the bifilar helices forming said receive quadrifilar helix antenna.

18. The antenna system of claim 12, wherein said transmit antenna is configured to transmit a right hand circularly polarized signal and wherein said receive antenna is configured to receive a right hand circularly polarized signal.

19. A half duplex antenna system comprising:

a receive quadrifilar helix antenna for receiving radio frequency signals in the 1525 MHz to 1559 MHz frequency band with a directivity in excess of 3 dBi for all elevation angles exceeding 45°, having four helical filars of less than 10 centimeters in length, said filars arranged orthogonally and excited in phase quadrature;

a transmit quadrifilar helix antenna for transmitting electrical signals in the 1626.5 MHz to 1660.5 MHz frequency band with a directivity in excess of 3 dBi for all elevation angles exceeding 45°, comprising four helical filars of less than 10 centimeters in length, said filars arranged orthogonally and excited in phase quadrature;

first coupling means for electrically connecting the signal from said receive quadrifilar helix antenna to said receiver;

second coupling means for electrically connecting the signal from said transmitter to said transmit quadrifilar helix antenna;

first disconnecting means for electrically isolating the bifilar helices of said transmit quadrifilar antenna from said receiver during periods of transmission; and second disconnecting means for electrically isolating the bifilar helices of said receive quadrifilar helix antenna from said transmitter when the antenna system is operating in the receive mode; and wherein one of said transmit quadrifilar helix antenna and said receive quadrifilar helix antenna is disposed within the cylinder defined by the other of said transmit quadrifilar helix antenna and said receive quadrifilar helix antenna.

20. The antenna system of claim 19, wherein said transmit antenna is configured to transmit a right hand circularly polarized signal and wherein said receive antenna is configured to receive a right hand circularly polarized signal.

21. The antenna system of claim 19, wherein said transmit quadrifilar helix antenna is disposed within the cylinder defined by said receive quadrifilar helix antenna.

22. The antenna system of claim 19, wherein said receive quadrifilar helix antenna is disposed within the cylinder defined by said transmit quadrifilar helix antenna.

23. The antenna system of claim 19, wherein each of said filar helices comprises a helix with a pitch angle greater than about 55 degrees and less than about 85 degrees.

* * * * *